US008544972B2

(12) United States Patent
Pae

(10) Patent No.: US 8,544,972 B2
(45) Date of Patent: Oct. 1, 2013

(54) REFRIGERATOR, REFRIGERATOR DOOR HANDLE, AND ASSEMBLING METHOD OF THE REFRIGERATOR DOOR HANDLE

(75) Inventor: Chanju Pae, Changwon (KR)

(73) Assignee: LG Electronics Inc., Seoul (KR)

( * ) Notice: Subject to any disclaimer, the term of this patent is extended or adjusted under 35 U.S.C. 154(b) by 160 days.

(21) Appl. No.: 12/918,640

(22) PCT Filed: Dec. 1, 2008

(86) PCT No.: PCT/KR2008/007099

§ 371 (c)(1),
(2), (4) Date: Aug. 20, 2010

(87) PCT Pub. No.: WO2009/104857

PCT Pub. Date: Aug. 27, 2009

(65) Prior Publication Data

US 2010/0327721 A1 Dec. 30, 2010

(30) Foreign Application Priority Data

Feb. 21, 2008 (KR) ..... 10-2008-0015772
Feb. 21, 2008 (KR) ..... 10-2008-0015775

(51) Int. Cl.
*A47B 96/04* (2006.01)

(52) U.S. Cl.
USPC ..... 312/405; 16/412; 16/436

(58) Field of Classification Search
USPC ..... 312/405, 326–329, 244, 348.6, 348.69, 312/204; 16/412, 436, 444
See application file for complete search history.

(56) References Cited

U.S. PATENT DOCUMENTS

| | | | | |
|---|---|---|---|---|
| 3,766,598 | A * | 10/1973 | Roberts | 16/444 |
| 3,995,349 | A * | 12/1976 | Roberts et al. | 16/412 |
| 4,087,141 | A * | 5/1978 | Roberts | 312/348.6 |
| 4,745,656 | A * | 5/1988 | Revlett | 16/412 |
| 5,810,372 | A * | 9/1998 | Arendt | 280/33.992 |
| 6,119,309 | A * | 9/2000 | Lu | 16/114.1 |
| 6,672,552 | B1 * | 1/2004 | Jao | 248/251 |
| 6,903,882 | B1 * | 6/2005 | Cameron et al. | 359/803 |
| 6,954,967 | B2 * | 10/2005 | Park et al. | 16/412 |
| 7,175,303 | B2 * | 2/2007 | Kovacik et al. | 362/240 |
| 7,263,744 | B2 * | 9/2007 | Kim et al. | 16/436 |
| 7,600,902 | B2 * | 10/2009 | Wang | 362/501 |
| 8,108,956 | B2 * | 2/2012 | Forrest | 4/576.1 |
| 8,108,972 | B2 * | 2/2012 | Bae et al. | 16/412 |
| 2002/0044456 | A1 * | 4/2002 | Balestriero et al. | 362/555 |
| 2003/0200632 | A1 * | 10/2003 | Schneider | 16/444 |
| 2004/0205916 | A1 * | 10/2004 | Byun | 15/143.1 |

(Continued)

FOREIGN PATENT DOCUMENTS

| | | | |
|---|---|---|---|
| KR | 1999-0062173 | A | 7/1999 |
| KR | 10-2007-0028188 | A | 3/2007 |
| WO | WO 2007/029978 | A1 | 3/2007 |

*Primary Examiner* — Darnell Jayne
*Assistant Examiner* — Hiwot Tefera
(74) *Attorney, Agent, or Firm* — Birch, Stewart, Kolasch & Birch, LLP

(57) ABSTRACT

A door handle for a refrigerator is provided. The door handle includes a graspable handle main body, a receiving member coupled to the handle main body and provided with a receiving portion, one or more decorations received in the receiving portion, and a handle cover coupled to the handle main body and supporting at least a portion of the decoration. As the decorations are stably installed on the door handle, the exterior beauty of the refrigerator can be improved. This satisfies the user.

15 Claims, 6 Drawing Sheets

(56) References Cited

U.S. PATENT DOCUMENTS

2005/0265019 A1* 12/2005 Sommers et al. ..... 362/217
2006/0282987 A1* 12/2006 Shih et al. ..... 16/412
2007/0086201 A1* 4/2007 Wang ..... 362/501
2008/0024047 A1* 1/2008 Juo et al. ..... 312/405
2008/0053771 A1* 3/2008 Wu ..... 190/115
2008/0254178 A1* 10/2008 Allen et al. ..... 426/389
2010/0326115 A1* 12/2010 Pae ..... 62/264

* cited by examiner

REFRIGERATOR, REFRIGERATOR DOOR HANDLE, AND ASSEMBLING METHOD OF THE REFRIGERATOR DOOR HANDLE

TECHNICAL FIELD

The present disclosure relates to a refrigerator, a refrigerator door handle, and an assembling method of the refrigerator door handle.

BACKGROUND ART

Generally, a refrigerator is an electrical appliance that keeps food fresh for a long time by maintaining an interior temperature thereof to be lower than an exterior temperature.

As the diet has shafted and the product has luxurious, the refrigerator has been large-sized and pursued the multi-purpose. Therefore, refrigerators having different structures and convenience functions considering the user convenience have been released.

Further, in recent years, not only the functions but also the design of the refrigerators have had an effect on buying decision. Therefore, refrigerators having a variety of color senses, feels of material, and patterns have been developed.

A case in a point is the printing of a variety of colors and patterns on a surface of a main body of the refrigerator or a front surface of a refrigerator door. Further, in order to give the refrigerator a really deluxe feeling, the main body or door may be entirely or partly formed of tempered glass.

Further, by applying design items such as decorations to a door handle, it is possible to make the refrigerator having a beautiful exterior. This satisfies the users and encourages consumers to buy.

Meanwhile, according to the related art refrigerator, as the user frequently manipulates the door handle, the design items provided on the door handled gets dirty or damaged.

DISCLOSURE OF INVENTION

Technical Problem

Embodiments provide a refrigerator door handle that is designed such that decorations can be effectively fixed thereon.

Embodiments also provide a refrigerator door handle that is configured to allow decorations mounted thereon to be viewed by being reflected to an external side.

Technical Solution

In one embodiment, a door handle for a refrigerator includes a graspable handle main body; a receiving member coupled to the handle main body and provided with a receiving portion; one or more decorations received in the receiving portion; and a handle cover coupled to the handle main body and supporting at least a portion of the decoration.

In another embodiment, a refrigerator includes a main body defining a storage chamber, a door pivotally coupled to the main body, a door handle provided on the door, and one or more decorations built in the door handle and exposed to an external side, wherein the door handle includes a handle main body defining an exterior of the door handle, a receiving member mounted on the handle main body and provided with a receiving portion supporting at least one side of the decoration, and a handle cover covering a front portion of the receiving member.

In still another embodiment, an assembling method of a door handle for a refrigerator includes mounting a receiving member having a receiving portion on a handle main body; receiving one or more decorations in the receiving portion; and coupling a cover member to the handle main body.

Advantageous Effects

According to the embodiments, the decorations are effectively fixed on the door handle and thus the refrigerator has a beautiful exterior, thereby satisfying a user.

Further, since a plurality of decorations can be effectively received in the door handle, there is no need to attach the decorations to the door handle using adhesive or other fasteners.

As the mounting of the decorations can be easily performed, the work speed increases and thus the productivity can be improved.

Further, since the decorations are effectively reflected by a reflective layer formed on the door handle, an effect that the number of the decorations seems to be greater than the number of the decorations that are actually mounted can be attained.

Accordingly, the number of the decorations can be remarkably reduced and thus the material cost can be reduced. Furthermore, the number of work processes is reduced and thus the productivity can be improved.

In conclusion, the exterior can be more luxurious while the number of the decoration is reduced.

The details of one or more embodiments are set forth in the accompanying drawings and the description below. Other features will be apparent from the description and drawings, and from the claims.

BEST MODE FOR CARRYING OUT THE INVENTION

Reference will now be made in detail to the embodiments of the present disclosure, examples of which are illustrated in the accompanying drawings. It should be understood that numerous other modifications and embodiments can be devised by those skilled in the art that will fall within the spirit and scope of the principles of this disclosure.

A refrigerator door handle of this disclosure can be applied to any types of refrigerators. For convenience, in the following embodiments, description is made on a side-by-side type refrigerator.

Figure 1:
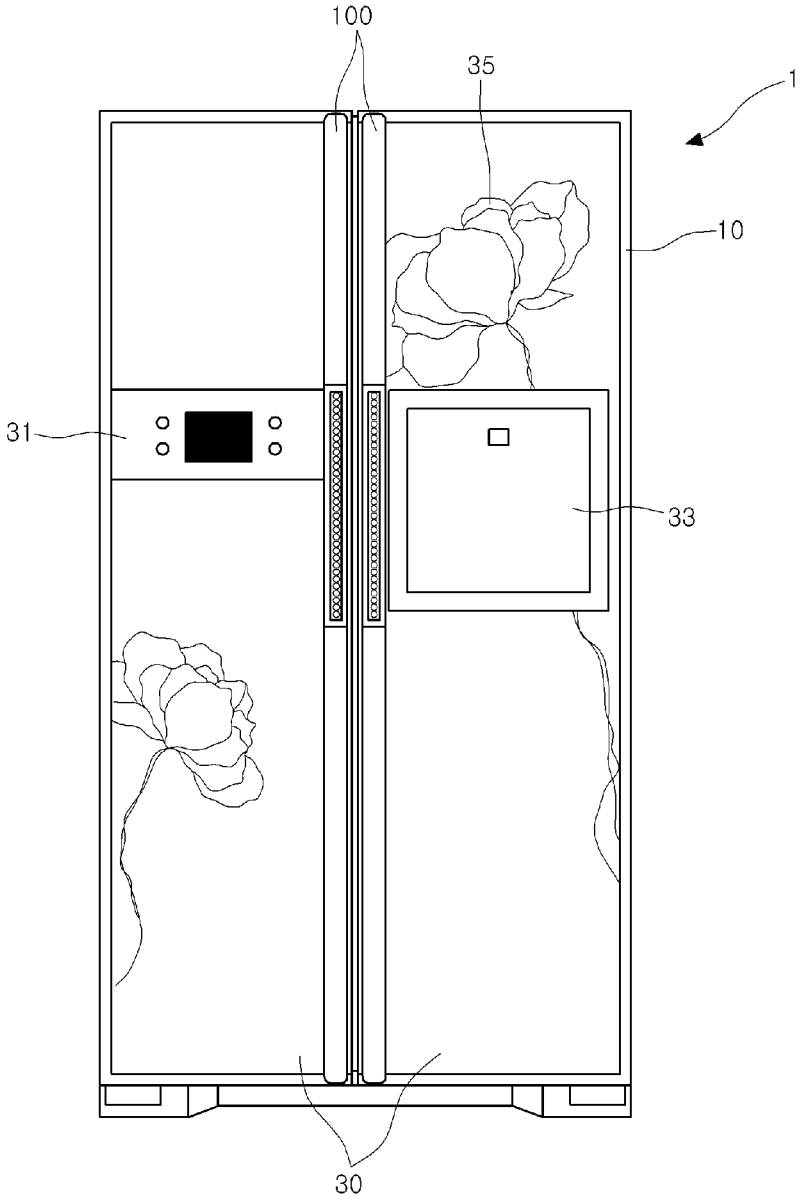
FIG. 1 is a schematic view of a refrigerator according to an embodiment.

FIG. 1 is a schematic view of a refrigerator according to an embodiment.

Referring to FIG. 1, a refrigerator 1 of an embodiment includes a main body 10 defining a storage chamber and a plurality of doors 30 pivotally coupled to a front portion of the main body 10.

The main body 10 is formed in an approximately rectangular parallelepiped shape, having an opened front portion. An interior of the main body is divided into a plurality of spaces to form chilling and freezing chambers.

The doors 30 selectively open the main body 10. When the doors 30 prevents the cool air from leaking out of the refrigerator.

A display unit 31 displaying an operation state of the refrigerator is provided on the door 30. A plurality of input units through which an operational condition of the refrigerator is input may be provided on the display unit 31.

Further, the door 30 is provided with a home bar 33 through which a user can conveniently takes out foodstuff. Although not shown in FIG. 1, the door 30 may be further provided with a dispenser for dispensing ice and/or water.

A pattern portion 35 in a variety of colors and patterns is formed on the door 30. The pattern portion 35 makes the exterior of the refrigerator beautiful.

Each of the doors 30 is provided with a door handle 100.

The door handles 100 are mounted on abutting ends of the front surfaces of the doors 30. The door handles 100 extend in a vertical direction.

The door handles 100 are arranged to be spaced apart from the front surfaces of the doors 30 so that the user can easily grasp the door handles 100.

Figure 2:
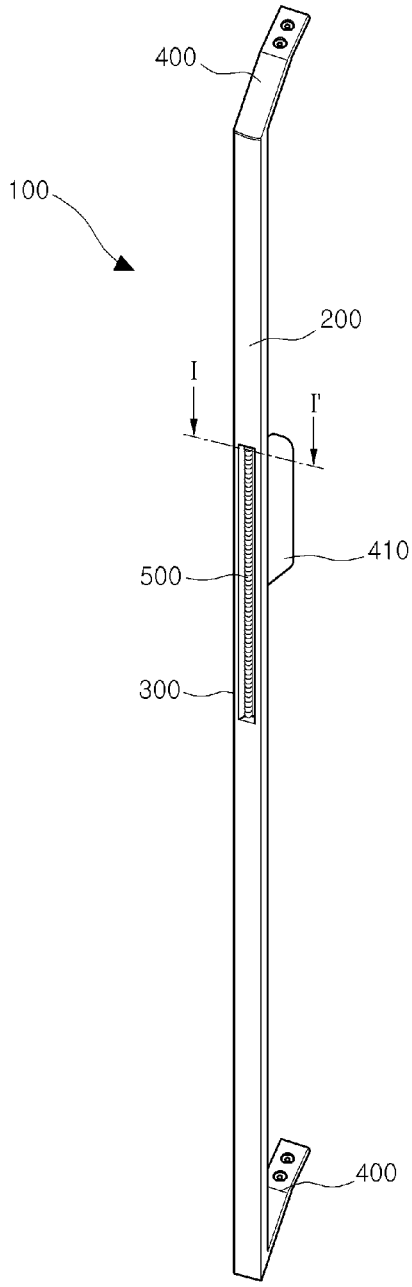
FIG. 2 is a perspective view of a door handle according to an embodiment.
Figure 3:
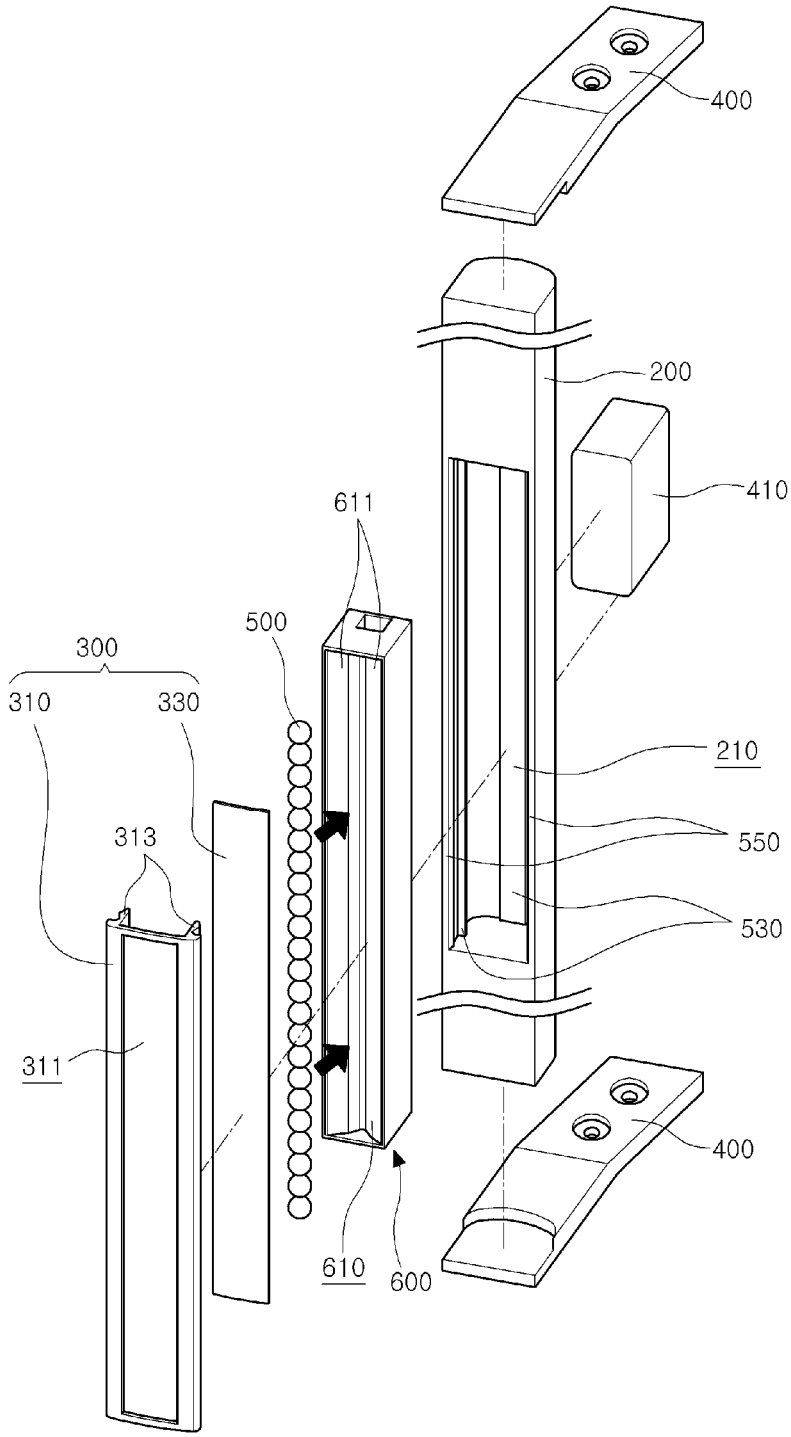
FIG. 3 is an exploded perspective view of the door handle of FIG. 2.
Figure 4:
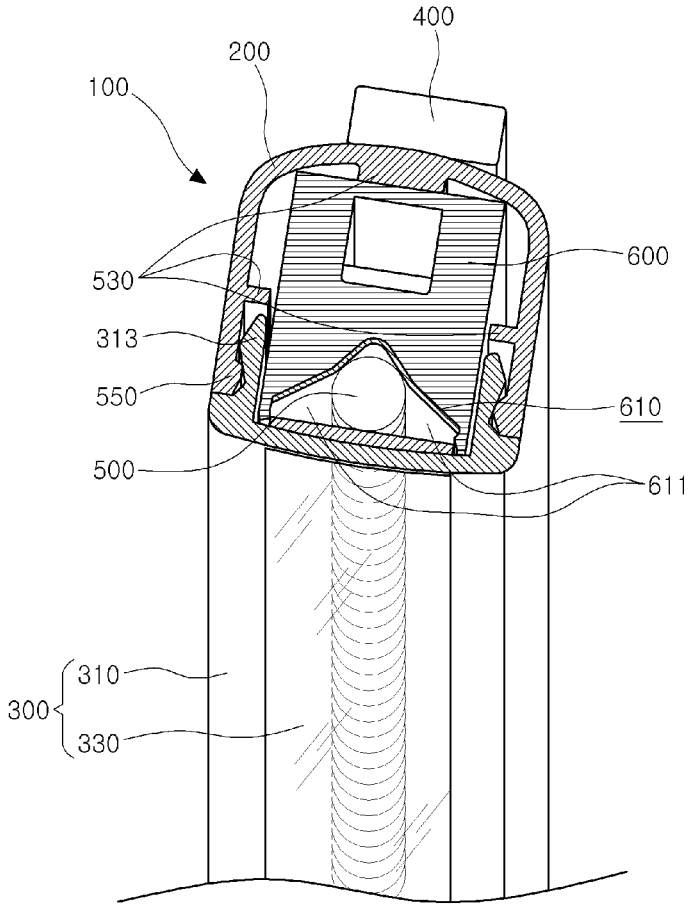
FIG. 4 is a cross-sectional view of the door handle of FIG. 2.
Figure 5:
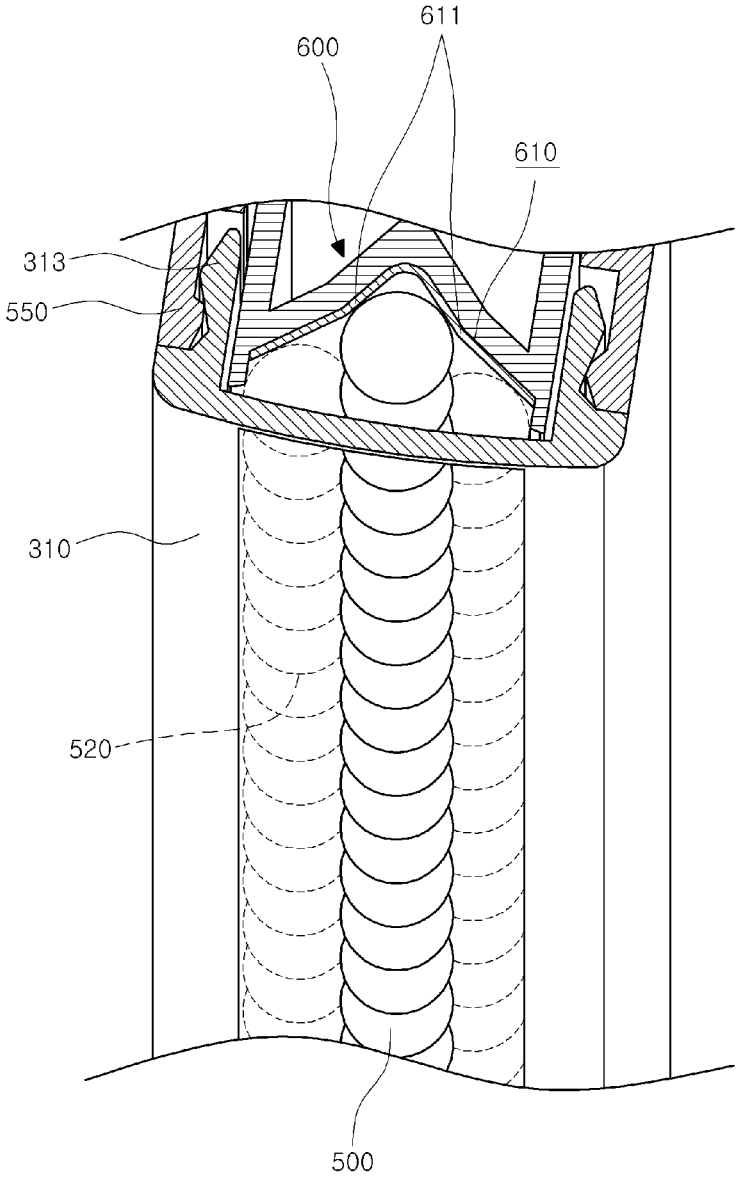
FIG. 5 is a cross-sectional view of the door handle of FIG. 4, illustrating a state where decorations are reflected.

FIG. 2 is a perspective view of the door handle, FIG. 3 is an exploded perspective view of the door handle of FIG. 2, FIG. 4 is a cross-sectional view of the door handle of FIG. 2, and FIG. 5 is a cross-sectional view of the door handle of FIG. 4, illustrating a state where decorations are reflected.

Referring to FIGS. 2 through 5, the door handle 100 is formed in a bar shape extending in the vertical direction. In order to improve the grasping sense of the user, corners of the door handle 100 are rounded.

The door handle 100 includes a handle main body 200 defining an exterior of the door handle 100, a handle cover 300 shielding at least a portion of the handle main body 100, connecting members 400 that is provided on upper and lower ends of the handle main body 200 to space the door handle 100 from the front surface of the door 300, decorations 500 that is received in the handle main body to make the refrigerator look more attractive, and a receiving member 600 that is mounted on the handle main body 200 to receive the decorations 500.

Here, the connecting members 400 are bent from the upper and lower ends of the handle main body 200 toward the front surface of the door 30. First sides of the connecting members 400 are coupled to the door 30.

By the above-described structure, the door handle 100 is spaced apart from the front surface of the door 30 and thus the user can grasp the door handle 100 through the space defined between the door handle 100 and the front surface of the door 30.

Further, the door handle 100 further includes a sub-connecting member 410 connecting a rear surface of the handle main body 200 to the front surface of the door 30 to preventing the door handle 100 from shaking.

The sub-connecting member 410 may be disposed on a central portion of the rear surface of the door handle 100.

In more detail, the handle main body 200 is provided with a recess 210 in which the decorations 500 are received. The recess 210 is recessed rearward from the front surface of the handle main body 200.

The receiving member 600 has a corresponding shape to the recess 210 and extends in the vertical direction. The receiving member 600 may be formed not to protrude frontward from the handle main body 200 in a state where it is mounted in the recess 210.

The receiving member 600 is provided with a receiving portion 610 receiving the decorations 500. The receiving portion 610 is formed along a length direction of the receiving member 600 and recessed rearward from the front surface of the receiving member 600.

Further, the receiving portion 610 has a V-shaped section and has an opened front portion. That is, the receiving portion 610 is formed in a wedge shape having a width that is gradually reduced rearward from the opened front portion.

Top and bottom surfaces of the receiving portion 610 are closed. In this case, when the decorations 500 are received in the receiving portion 610, the decorations 500 are not removed out of the receiving portion 610 through the top and bottom surfaces of the receiving portion 610.

Meanwhile, the decorations 500 can be continuously mounted in the receiving portion 610 in the vertical direction.

As the decorations 500 are provided to improve the beauty of the exterior of the refrigerator 1, they are formed of cubic or crystal, noble metal, noble stone, glass, and the like. A plurality of the decorations 500 are mounted such that they can be exposed to an external side through the front surface of the door handle 100.

In FIG. 3, the decorations 500 formed in a bead shape are illustrated. However, the present disclosure is not limited to this configuration. For example, the decoration 50 may be formed in a diamond shape.

In brief, the decorations 50 are filled in the receiving portion 610 from the opened front portion one by one and supported by the top and bottom surfaces of the receiving portion 610. As a result, the decoration 500 cannot move in the vertical direction.

Meanwhile, a reflective layer 611 is formed on an inner surface of the receiving portion 610, which is adjacent to the decorations 500. The reflective layer 611 is inclined by the receiving portion 610 that is inclined. That is, the reflective layer 611 may be located at both sides (left and right sides) of the decorations 500.

That is, the reflective layer 611 may be arranged in a wedge shape having a width that is gradually reduced rearward from the receiving member 600.

An inclined angle of the reflective layer 611 may be determined such that the decorations 500 can be reflected and exposed to the external side.

The reflective layer 611 may be provided in the form of a minor that can reflect the decorations. The reflective layer 611 may be entirely or partly formed on the inner surface of the receiving member 600.

The reflective layer 611 may be formed through a plating process using aluminum or silver or through a vacuum deposition process using aluminum or silver. Alternatively, the reflective layer 611 may be formed by attaching a coating-processed film. At this point, the film is attached on an entire portion or some of the inner surface of the receiving portion 610.

As shown in FIG. 5, when the decorations 500 are reflected by the reflective layer 611, reflected decorations 520 are formed at the right and left sides of the decorations 500. That is, an effect that the number of the decorations seems to be greater than the number of the decorations that are actually mounted can be attained.

Accordingly, when the user sees the receiving member 600 on which the decorations 500 are mounted, the user sees three lines of the decorations 500.

Further, mounting ribs 530 for not only preventing the receiving member 600 mounted from shaking but also guiding the mounting of the receiving member 600 at the right position are provided inside the handle main body 200.

The mounting ribs 530 are mounted to extend from the inner surface of the handle main body 200. In a state where the receiving member 500 is mounted on the handle main body 200, the mounting ribs 530 support at least one surface of the receiving member 600.

In a state where the receiving member 600 is mounted on the handle main body 200, a front portion of the handle main body 200 is covered by the handle cover 300.

The handle cover 300 has a corresponding size to the recess 210 so that it can define a portion of the front surface of the door handle 100 and cover the recess 210. Further, the handle cover 300 may be formed to have a corresponding size to the receiving portion 610 receiving the decorations 500.

In more detail, the handle cover 300 includes a cover frame 310 defining an exterior of the handle cover 300, and a seeing-through window 330 through which the decorations 500 are exposed to the external side.

The cover frame 310 is provided with an seeing-through portion 311 defined by an opening. The seeing-through portion 311 is formed through almost entire central portion of the front surface of the cover frame 310 except for an edge of the front surface.

Here, the seeing-through portion 311 is sized such that all of the decorations 500 received in the receiving portion 610 can be exposed to the external side. The decorations 500 can be viewed through the seeing-through portion 311.

The seeing-through window 330 is disposed between the receiving member 500 and the seeing-through portion 311 and is formed to having a corresponding size to the seeing-through portion 311 and the receiving portion 610 to cover the seeing-through portion 311 and the receiving portion 610.

By the above-described structure, the seeing-through window 330 can simultaneously cover the seeing-through portion 311 and the front surface of the receiving portion 610. Here, the seeing-through window 330 is formed of a transparent or translucent material.

Meanwhile, when the handle cover 300 is coupled in a state where the decorations 500 are received in the receiving portion 610, the decorations 500 contact not only the inner surface of the receiving portion 610 but also the seeing-through window.

Therefore, since the decorations 500 are safely supported by the receiving portion 610 and the seeing-through window 330, the movement of the decorations 500 can be prevented.

In brief, in a state where the decorations 500 are received in the receiving member 600, the receiving member 600 is mounted in the handle main body 200. In this case, when the handle cover 300 is coupled to the handle main body 200, the decorations 500 are stably supported by the top and bottom surfaces of the receiving portion 610 and the receiving portion 610 and seeing-through window 330 and thus the removal of the decorations 500 in a direction can be prevented.

The cover frame 310 is provided with a cover hooking portion 313 on which the handle cover 300 coupled to the handle main body 200 is hooked. The hooking portion 313 protrudes rearward from the rear surface of the cover frame 310. A plurality of hooking portions 313 may be formed on both sides of the cover frame 310.

The handle main body 200 is provided with main body hooking portions 550 corresponding to the cover hooking portions 313. The main body hooking portions 313 are shaped to correspond to the cover hooking portions 313.

When the cover hooking portions 313 are interlocked with the main body hooking portions 550, the handle main body 200 and the handle cover 300 are stable fixed to each other. Needless to say, in the course of separating the handle main body 200 and the handle cover 300 from each other, the interlocking between the cover hooking portion 313 and the main body hooking portion 550 can be easily released.

Meanwhile, a distance between the cover hooking portions 313 is slightly greater than a width of the front surface of the receiving member 600. The receiving member 600 is fitted between the cover hooking portions 313.

When the handle cover 300 is coupled to the handle main body 200, the front surface of the receiving member 600 contacts the rear surface of the cover frame 310.

In the drawings, it is illustrated that the receiving member 600 is formed independent from the handle main body 200. However, it may be also possible to form the receiving portion 610 in the handle main body 200. Needless to say, in this case, the reflective layer 611 is also formed on the receiving portion 610.

Meanwhile, it is described in the embodiment, the reflective layer 611 is formed as planar planes formed at both sides of the decorations 500. However, the present disclosure is not limited to this configuration. The reflective layer 611 may be multi-stepped or bent. That is, it may be possible to form the reflective layer such that more decorations 500 can be viewed by the reflection of the reflective layer.

The following will describe an assembling method of the refrigerator door handle structure as described above.

First, the handle main body 200 is prepared and the receiving member 600 is mounted in the recess 210 of the handle main body 200. The receiving member 600 is supported and guided by the mounting ribs 530 and the receiving portion 610 is exposed frontward.

Here, the reflective layer 610 may be formed on the receiving portion 610 in advance.

The decorations 600 are sequentially disposed in the receiving portions 610 one by one. At this point, the number of the decorations 500 is determined by the size of the receiving portion 610.

When the decorations 500 are inserted in the receiving portions 610, the decorations 500 are stacked one another and contact one another. The lowermost and uppermost decorations 500 are supported by the bottom and top surfaces of the receiving portion 610 and thus the decorations 500 are not separated in the vertical direction.

After installing the decorations 500, the handle cover 300 is mounted on the handle main body 200. Here, the handle cover 300 may be pushed rearward from the front portion of the recess 210.

Then, the cover hooking portions 313 of the cover frame 310 can be interlocked with the main body hooking portion 550 formed on the handle main body 200. Accordingly, the handle main body 200 and the handle cover 300 may be coupled to each other.

When the mounting of the handle cover 300 is completed, the rear surface of the handle cover 300, i.e., the rear surface of the seeing-through window 330 supports the front portions of the decorations 500. Accordingly, the decorations 500 cannot move frontward.

Further, rear portions of the decorations 500 can be stably supported by the receiving portion 610.

The decorations 500 installed can be viewed through the seeing-through window 330. As described above, since the decorations 500 are reflected on the reflective layer 611, the actual decorations 500 and the reflected decorations 520 can be exposed to the external side.

After assembling the handle cover 300, the connecting members 400 are connected to the upper and lower ends of the handle main body 200. Further, the sub-connecting member 410 is coupled to the central portion of the rear surface of the handle main body 200.

The connecting members 400 and the sub-connecting member 410 are coupled to the respective upper and lower ends and central portion of the front surface of the door 30. Therefore, the door handle 100 may be spaced apart from the front surface of the door 30 by a predetermined distance.

The assembling of the door handle 100 is completed through the above-described processes, after which the decorations 500 installed in the door handle 100 can be exposed to the external side.

When the door handle 100 is exposed to the external side, the reflected decorations 520 on the reflective layer 611 as well as the actual decorations 500 can be viewed through the seeing-through window 330.

As a result, an effect that the number of the decorations seems to be greater than the number of the decorations that are actually mounted can be attained. Therefore, the exterior beauty of the refrigerator can be improved and the manufacturing cost can be reduced.

The following will describe another embodiment. This embodiment is substantially identical to the foregoing embodiment of FIGS. 1 through 5 except for the structure of the receiving member. Therefore, like reference numbers will be used to refer to like parts.

Figure 6:
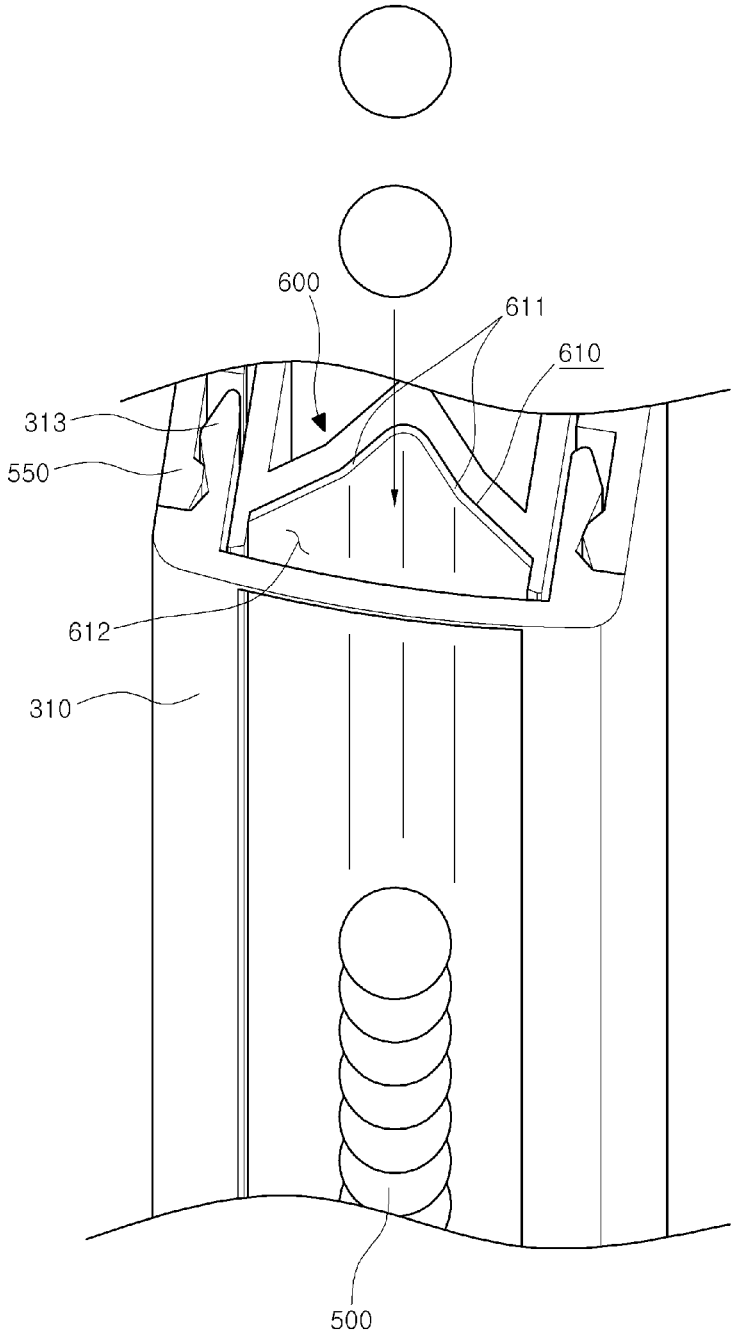
FIG. 6 is a cross-sectional view of a refrigerator door handle according to another embodiment.

FIG. 6 is a cross-sectional view of a refrigerator door handle according to another embodiment.

Referring to FIG. 6, a receiving member of this embodiment includes an opened top portion 612.

That is, an upper end portion of the receiving member 610 is opened by the opened top portion 612.

Decorations 500 are may be inserted through the opened top portion 612. In more detail, the decorations 500 are received through the opened top portion 612 one by one, in the course of which the decorations 500 may be stacked at a side of the receiving portion 610.

The following will describe an assembling process of the door handle 100.

First, a handle cover 300 is coupled to the receiving member 600. At this point, a seeing-through window 330 may be interposed in advance between the handle cover 300 and the receiving member 600. Then, a predetermined receiving space is defined in the receiving member 600 by the seeing-through window 330 and the receiving portion 610.

Next, the decorations 500 are sequentially received in the receiving member 600 through the opened top portion 612. Subsequently, the opened top portion 612 is sealed.

Then, the uppermost decoration 500 can be supported by the sealed top portion 612.

As described above, the receiving member 600 receiving the decorations 500 is mounted in a recess 210 of a handle main body 200, after which a handle cover 300 is coupled to the handle main body 200.

According to this embodiment, an assembling process of the decorations 500 can be simplified.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Industrial Applicability

According to the above-described door handle assembling process, the assembling process can be simplified. In addition, since more decorations than the number of the actual decorations can be viewed, the exterior beauty of the refrigerator can be improved the manufacturing costs can be reduced. Therefore, the industrial applicability is remarkably high.

The invention claimed is:

1. A door handle for a refrigerator, comprising:

a pair of handle holders mounted on a door of the refrigerator;

a handle main body assembled with the handle holders;

a receiving member coupled to the handle main body and provided with a receiving portion disposed at a front portion of the receiving member;

a V-shaped reflective layer in the receiving portion;

a handle cover coupled to the receiving member and made of transparent material, the handle cover and the v-shaped reflective layer defining a receiving space; and a plurality of three-dimensional objects received in the receiving space and positioned in front of the V shaped reflective layer, wherein the V-shaped reflective layer has two surfaces by which the three dimensional objects are reflected so that reflected decorations on the two surfaces of the V-shaped reflective layer are formed at the right and left sides of the three dimensional objects.

2. The door handle according to claim 1, wherein a front portion of the receiving member is opened and the three dimensional objects are received in the receiving portion through the opened front portion of the receiving member.

3. The door handle according to claim 1, wherein the receiving member has an opened top portion and the three dimensional objects are received in the receiving member through the opened top portion.

4. The door handle according to claim 1, wherein the handle cover comprises a seeing-through window interposed between a cover frame and the receiving portion.

5. The door handle according to claim 1, wherein the handle cover and the handle main body are respectively provided with hooking portions corresponding to each other.

6. The door handle according to claim 1, wherein the handle cover is formed to have a corresponding size to the receiving portion.

7. The refrigerator according to claim 1, wherein the V-shaped reflective layer comprises a film reflecting the three-dimensional objects.

8. The refrigerator according to claim 1, wherein the V-shaped reflective layer is formed through a plating process or a vacuum deposition process.

9. The refrigerator according to claim 1, wherein the receiving member has a width that is gradually reduced rearward and the V-shaped reflective layer is formed on surfaces of the receiving member, which define the width.

10. The refrigerator according to claim 1, wherein the handle cover comprises:

a cover frame provided with a hooking portion on which the handle main body is hooked; and a seeing-through window supporting a side of the three-dimensional objects and allowing the three-dimensional objects to be exposed to an external side.

11. The refrigerator according to claim 1, wherein the three-dimensional objects are stacked to one another in a vertical direction.

12. The refrigerator according to claim 1, wherein the handle main body comprises:

a recess in which the receiving member is mounted; and a mounting rib protruding from a surface defining the recess and guiding a position of the receiving member.

13. An assembling method of a door handle for a refrigerator, comprising:

mounting a receiving member having a receiving portion on a handle main body, the receiving portion having a V-shaped reflective layer;

receiving a plurality of three-dimensional objects in the receiving portion such that the three-dimensional objects are positioned in front of the V-shaped reflective layer;

coupling a handle cover member being made of transparent material to the handle main body such that the handle cover and the V-shaped reflective layer of the receiving member define a receiving space; and coupling the handle main body to a plurality of handle holders, and wherein the V-shaped reflective layer has two surfaces by which the three dimensional objects are reflected, such that reflected decorations on the two surfaces of the V-shaped reflective layer are formed at the right and left sides of the three dimensional objects.

14. The assembling method according to claim 13, further comprising mounting the handle main body on a refrigerator door with a space between the handle main body and the door by coupling the handle holders to the refrigerator door.

15. The assembling method according to claim 13, wherein the receiving of the three-dimensional objects comprises receiving the three-dimensional objects in the receiving portion through an opened front portion of the receiving portion.

* * * * *